US011672303B2

(12) United States Patent
Cohen

(10) Patent No.: US 11,672,303 B2
(45) Date of Patent: Jun. 13, 2023

(54) FOOTWEAR WITH FLEXIBLE DISPLAY MEANS

(71) Applicant: Avihay Cohen, Akko (IL)

(72) Inventor: Avihay Cohen, Akko (IL)

( * ) Notice: Subject to any disclaimer, the term of this patent is extended or adjusted under 35 U.S.C. 154(b) by 0 days.

(21) Appl. No.: 17/423,117

(22) PCT Filed: Dec. 18, 2019

(86) PCT No.: PCT/IL2019/051382
§ 371 (c)(1),
(2) Date: Jul. 15, 2021

(87) PCT Pub. No.: WO2020/152666
PCT Pub. Date: Jul. 30, 2020

(65) Prior Publication Data

US 2022/0125152 A1 Apr. 28, 2022

(30) Foreign Application Priority Data

Jan. 24, 2019 (IL) ..... 264452

(51) Int. Cl.
*A43B 3/40* (2022.01)
*A43B 3/00* (2022.01)
*A43B 3/12* (2006.01)

(52) U.S. Cl.
CPC ..... *A43B 3/40* (2022.01); *A43B 3/0078* (2013.01); *A43B 3/128* (2013.01)

(58) Field of Classification Search
None
See application file for complete search history.

(56) References Cited

U.S. PATENT DOCUMENTS 4,158,922 A * 6/1979 Dana, III ..... A43B 3/102 36/137
5,921,653 A * 7/1999 Chien ..... B60Q 1/326 362/234
6,874,904 B2 * 4/2005 Hsu ..... A43B 3/36 313/511
7,059,070 B2 * 6/2006 Omstead ..... A43B 1/0072 36/137
7,204,045 B2 * 4/2007 Lee ..... A43B 3/36 36/137
7,329,019 B2 * 2/2008 Cheung ..... G09F 21/02 362/228
7,618,356 B1 * 11/2009 Johnson ..... A63B 21/4025 482/127
7,766,501 B2 * 8/2010 Rapisarda ..... A43B 3/36 362/802
9,066,383 B2 * 6/2015 Gerszberg ..... H05B 47/19
(Continued)

FOREIGN PATENT DOCUMENTS

CN 107979978 A 5/2018
KR 20150005581 A 1/2015
(Continued)

*Primary Examiner* — Jila M Mohandesi
(74) *Attorney, Agent, or Firm* — Caesar Rivise, PC

(57) ABSTRACT

The present invention relates to footwear with flexible display means, comprising: a) at least one strap that is comprised of a flexible thin display panel, b) a sole comprising attachment latches adapted to attach the at least one strap to the sole; and an electrical circuitry configured to enable the flexible thin display panel to display digital content.

18 Claims, 6 Drawing Sheets

(56) References Cited

U.S. PATENT DOCUMENTS

| | | | | |
|---|---|---|---|---|
| 9,781,967 | B2 * | 10/2017 | Smith, III | A43B 3/12 |
| 10,306,726 | B2 * | 5/2019 | Wilken | H05B 45/20 |
| 2003/0231485 | A1 * | 12/2003 | Chien | A43B 1/0036 362/84 |
| 2008/0155860 | A1 * | 7/2008 | Tai | A43B 3/24 36/11.5 |
| 2010/0037486 | A1 | 2/2010 | Verheijen | |
| 2010/0289971 | A1 | 11/2010 | Odland et al. | |
| 2014/0283412 | A1 * | 9/2014 | Elder | A43B 13/16 36/102 |
| 2017/0318895 | A1 | 11/2017 | Thomasson | |

FOREIGN PATENT DOCUMENTS

| | | | |
|---|---|---|---|
| KR | 101539869 | B1 | 7/2015 |
| KR | 20170030316 | A | 3/2017 |

* cited by examiner

FOOTWEAR WITH FLEXIBLE DISPLAY MEANS

FIELD OF THE INVENTION

The invention is in the field of footwear. More specifically, the invention relates to footwear with flexible display means.

BACKGROUND OF THE INVENTION

Wearable computing is one of the fastest growing markets these days, with a faster pace of events, there is a growing demand for constant availability for communication and for real-time information. In parallel to the progress of compacted computing and communication devices, there is an ongoing development of thinner and flexible display devices, e.g. E-paper products. This progress adds a variety of wearable computing devices and enables the development of a new fashion area, of alternating displays of colors and design patterns utilizing thin display devices attached to footwear or to other garment. Another fashion of creating unique garments is altering a common on-shelf clothing by adding or removing portions of it. Another option is buying modular clothing e.g. pants with removable sleeves or shoes with removable or replaceable parts. Yet the prior art, does not satisfy both—the demand for wearable computing and the demand for fashionable personalized items—at the same time in a single garment.

The current invention harness the progress of thin display screens to modular footwear thus provides with a solution for individuals who would like personalized footwear, through controlling both—its physical shape and its appearance.

SUMMARY OF THE INVENTION

The present invention relates to footwear with flexible display means, comprising:

- at least one strap that is comprised of a flexible thin display panel;
- a sole comprising attachment latches adapted to attach the at least one strap to said sole; and
- an electrical circuitry configured to enable the flexible thin display panel to display digital content.

According to an embodiment of the invention, the electrical circuitry comprises a processing unit, a memory, a battery, data and electric power ports.

According to an embodiment of the invention, the electrical circuitry is located within the sole, within the strap or in both within said sole and within said strap.

According to an embodiment of the invention, the attachment latches are provided in form of data and electric power ports for electrically connecting between the at least one strap and the electrical circuitry and for mechanically connecting between the at least one strap and the sole.

According to an embodiment of the invention, the battery is of a rechargeable type and the electrical circuitry further comprising electrical charging means for charging the battery by an external charger in a wireless or wired manner.

According to an embodiment of the invention, further comprises an external memory device reader adapted to transfer digital content to the flexible thin display panel either directly or via the electrical circuitry.

According to an embodiment of the invention, further comprises a wireless communication device, to wirelessly communicate with a remote device which is utilized as a media source, and can control of the displayed digital content.

According to an embodiment of the invention, the sole comprises an electricity generation mechanism for charging the battery.

According to an embodiment of the invention, the electricity generation mechanism is embedded within the sole or within a heel of the sole.

According to an embodiment of the invention, the sole comprises a modular heel.

According to an embodiment of the invention, the sole is configured to power external power consuming devices.

According to an embodiment of the invention, further comprises one or more sensors adapted to manipulate the displayed digital content in accordance with readings provided by said one or more sensors.

According to an embodiment of the invention, the one or more sensors are a light sensing device, a sound sensing device or combination thereof.

According to an embodiment of the invention, the sole comprises a plurality of attachment latches that are distributed along said sole, thereby enabling to form variety of designs by combining the attachment of one or more straps at different location of said sole.

DETAILED DESCRIPTION OF THE DRAWINGS

Throughout this description the term "strap" is used to indicate parts of footwear above the sole. This term does not imply any particular shape, construction material or geometry, and invention is applicable to all suitable parts of the footwear above the sole.

The invention relates to footwear with flexible display means, such as a shoe or a sandal with one or more modular media display straps (i.e., the term display strap refers herein to a strap that is comprised of a flexible thin display panel). According to an embodiment of the invention, the upper structure of the footwear comprised of media display straps enabling display of digital content (e.g., internal stored media, or externally stored or streamed media), thus controlling of the appearance of the footwear. According to an embodiment of the invention, the footwear further comprises a sole in which several attachment latches are installed in multiple locations in the sole. This allows the attachment of a desirable number of display straps into variable attachment locations of the sole (e.g., the attachment latches can be located on an upper surface of the sole or at other suitable locations such as the sides of the sole). According to an embodiment of the invention, regular footwear straps (e.g., leather straps) can also be attached to the sole in addition or in combination with the display straps, thus partially or fully enclosing the footwear top composing a unique fashionable design. Furthermore, although the following description refers mostly to the use of rectangular shapes straps, other forms of regular/display straps in various shapes can be utilized in a similar manner.

Figure 1:
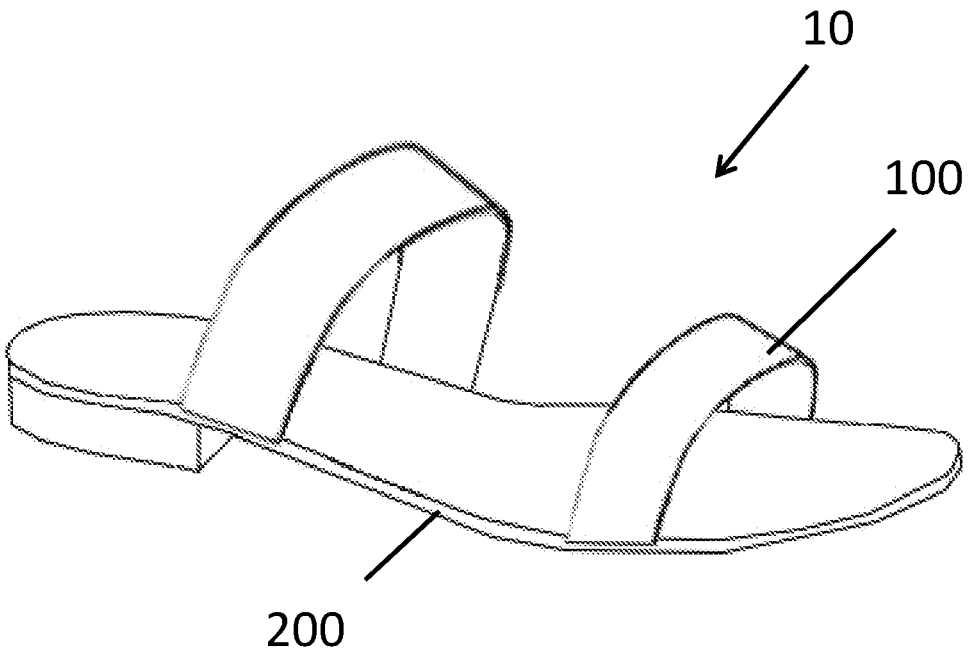
FIG. 1 schematically illustrates footwear with a display strap, according to an embodiment of the present invention.

FIG. 1 schematically illustrates footwear 10, according to an embodiment of the present invention. Footwear comprises a display strap 100, a sole 200 and an electrical circuitry that is configured to enable display strap 100 to display digital content. The electrical circuitry can be located within sole 200, within display strap 100 or in both thus some of the electronic components/modules can be located within sole 200 while the rest of them can be located within display strap 100.

Figure 2A:
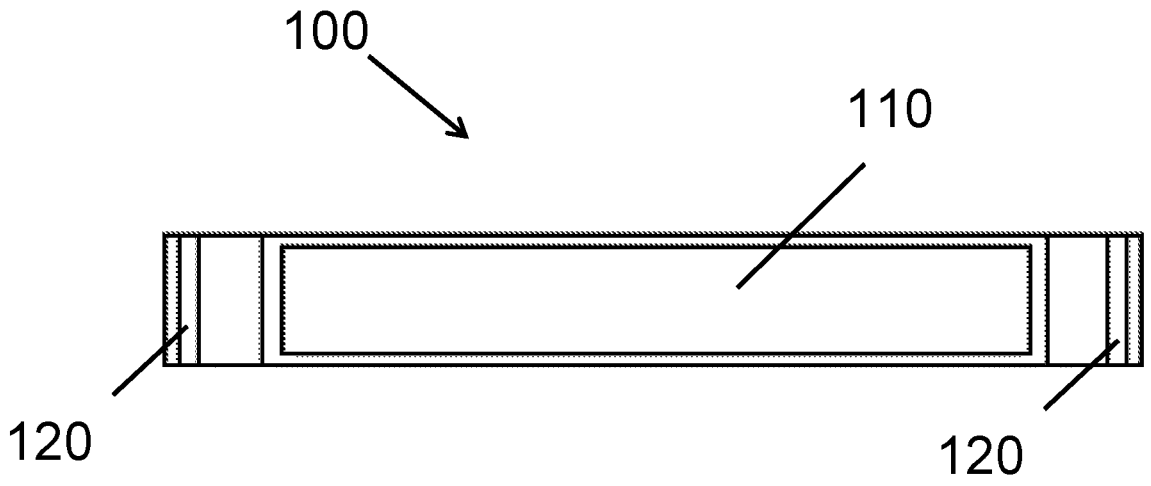
FIG. 2A schematically illustrates a flexible display strap, according to an embodiment of the present invention.

FIG. 2A schematically illustrates display strap 100, according to an embodiment of the present invention. Display strap 100 is comprised of a flexible thin display panel 110 of a certain technology, e.g., E-paper display (EPD), LED, OLED and the like. Display strap 100 further comprises attachment means 120, e.g., the can be located at its distal end or at both distal ends, to allow the attachment of display strap 100 to a corresponding attachment means located on a corresponding sole (e.g., as indicated by attachment means 201 and 202 of sole 200 in FIG. 2B).

According to an embodiment of the invention, display strap 100 may comprise a processing unit (not shown), an internal memory (not shown), a battery and separate or integrated electric charging and data input ports (e.g., micro USB port—not shown). In such embodiment, display strap 100 may operate as an independent or stand-alone media display unit.

In another embodiment of the present invented invention, display strap 100 is electrically charged wirelessly, utilizing a wireless charger and the appropriate electrical charging circuitry and internal battery. In another embodiment, attachment means 120 of display strap 100 is designed to allow both mechanical connection and electrical connection for transferring data and charging through the counter attachment means 201, 202 installed on sole 200 (FIG. 2B).

According to an embodiment of the present invention, the electrical circuitry may further comprise an external memory reader (e.g., SD card reader) through which a memory card loaded with digital content can be used as an external source for the displayed media.

According to an embodiment of the present invention, the electrical circuitry may further comprise wireless communication module (e.g., a Bluetooth module), allowing the utilization of an external or remote device (e.g., a mobile phone) to remotely transfer and/or display media files onto display strap 100.

Figure 2B:
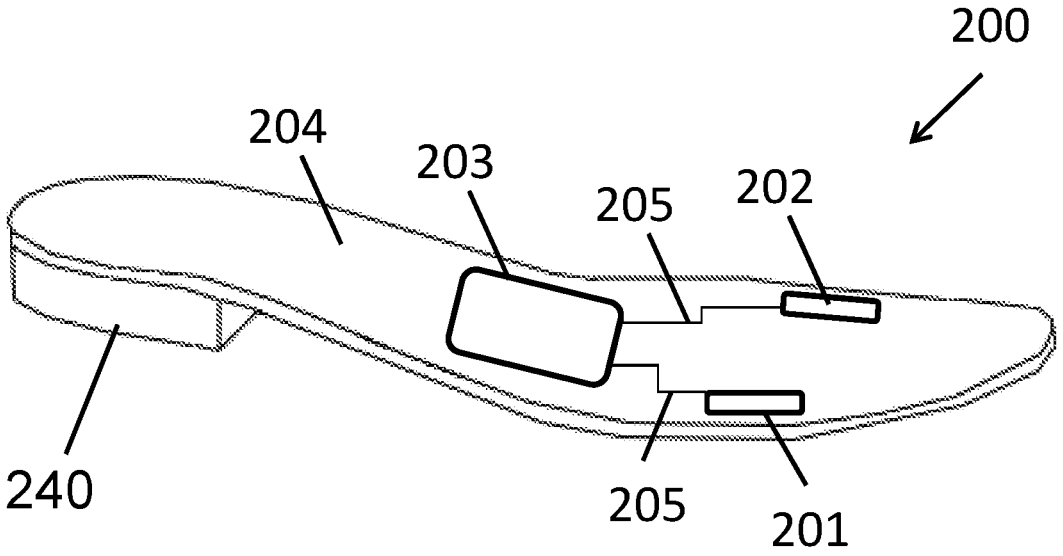
FIG. 2B schematically illustrates a perspective view the sole of the footwear of FIG. 1, according to an embodiment of the invention.

FIG. 2B schematically illustrates a perspective view of footwear's sole 200, according to an embodiment of the invention. Sole 200 comprises attachment means 201, 202, and an electrical circuitry 203 that is configured to enable a corresponding display strap (e.g., strap 100 of FIG. 1) to display digital content. In this figure, the upper layer 204 of sole is transparent through which electrical circuitry 203 and the wirings 205 that electrically connect attachment means 201, 202 to electrical circuitry 203 are shown. In this embodiment, sole 200 has a low heel 240.

Figure 2C:
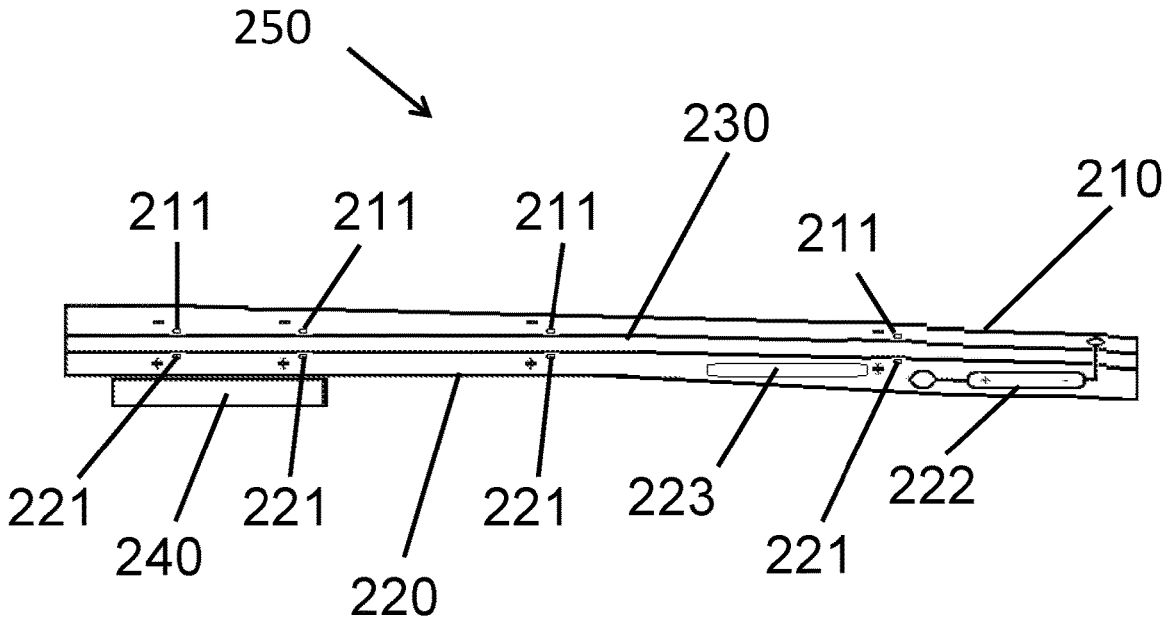
FIG. 2C shows an illustrated side view of a sole of a footwear, according to another embodiment of the present invention.

FIG. 2C schematically illustrates sole 250, according to another embodiment of the present invention, in which sole 250 provides electrical power to one or more display straps such as display strap 100. In this embodiment, sole 250 comprised of an upper-sole 210, in which a conductive line (not shown) connects multiple contacts 211 of negative electrical polarity, a lower-sole 220, in which a conductive line (not shown) connects multiple contacts 221 of a positive electrical polarity, and a mid-sole which can be utilized for the mechanical attachment of one or more display straps 100, grasping the display strap's power contacts against the counter contacts of the upper and lower soles. FIG. 2C further illustrates lower-sole 220 with an integrated battery 222 and electrical power control circuit 223, wherein battery 222 can be utilized as a power source to external items such as other garment items which comprise power consuming devices (e.g., shirt, trouser, etc.).

Of course, multiple attachment devices exist in the market, to enable a combination of a mechanical attachment and an electrical connection. The attachment of the display straps to the sole of the present invention is not limited to a specific attachment design, which can be different in various embodiments of the invented footwear.

According to an embodiment of the present invention, battery 222 is a replaceable battery. In another embodiment, battery 222 is a rechargeable battery, which can either be charged through a USB port (not shown), or through a wireless charging device and an appropriate power control circuit 223.

In the embodiments illustrated in FIGS. 2B and 2C, heel 240 is not utilized for a specific purpose of the present invention. According to another embodiment of the invention, the heel can be utilized for various purposes, e.g. for mechanical power generation for charging battery 222.

Figure 3:
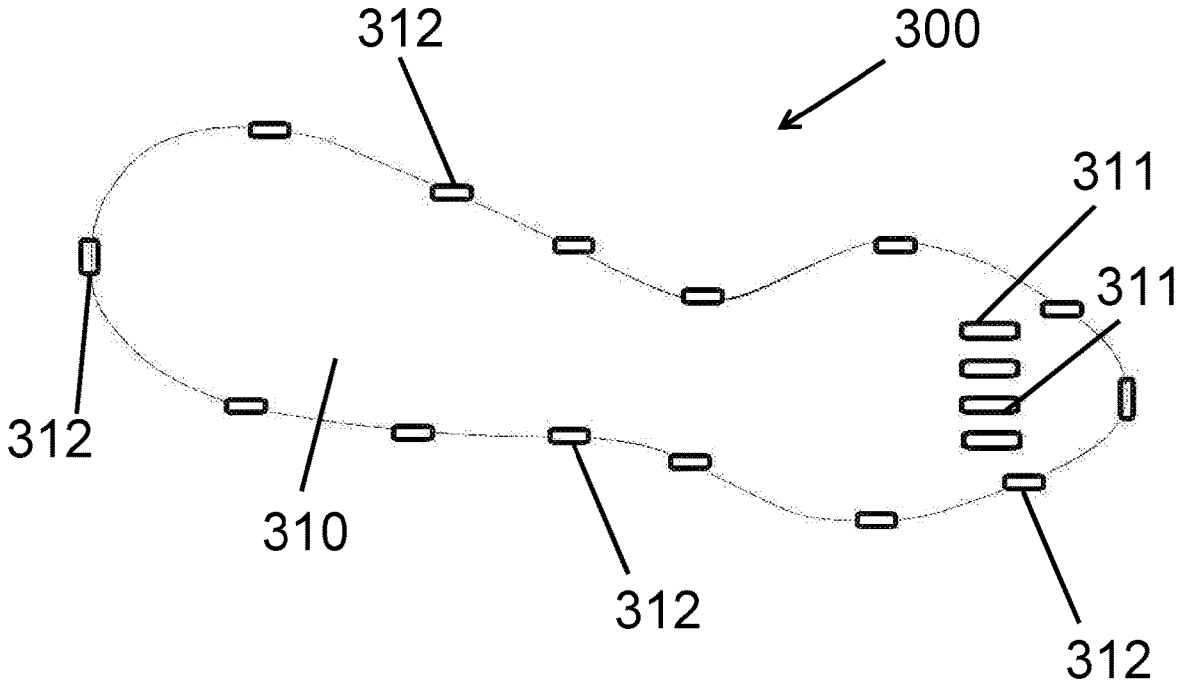
FIG. 3 shows an illustrated top view of t a sole of a footwear, according to an embodiment of the present invention.

FIG. 3 schematically illustrates a sole 300, according to an embodiment of the present invention. In this embodiment, sole 300 is provided with multiple optional attachment points (as indicated by numerals 311 and 312) of the aforesaid display straps 100 to sole 300 (e.g., attachment points 311 indicate of attachment locations on the upper surface 310 of sole 300, while attachment points 312 indicate of attachment location on along the side of sole 300). Of course, different attachment types are utilized for attachments at the middle of the sole's surface 311 (for example for a short strap at the large toe location), or at the sole's perimeter 312.

Figure 4A:
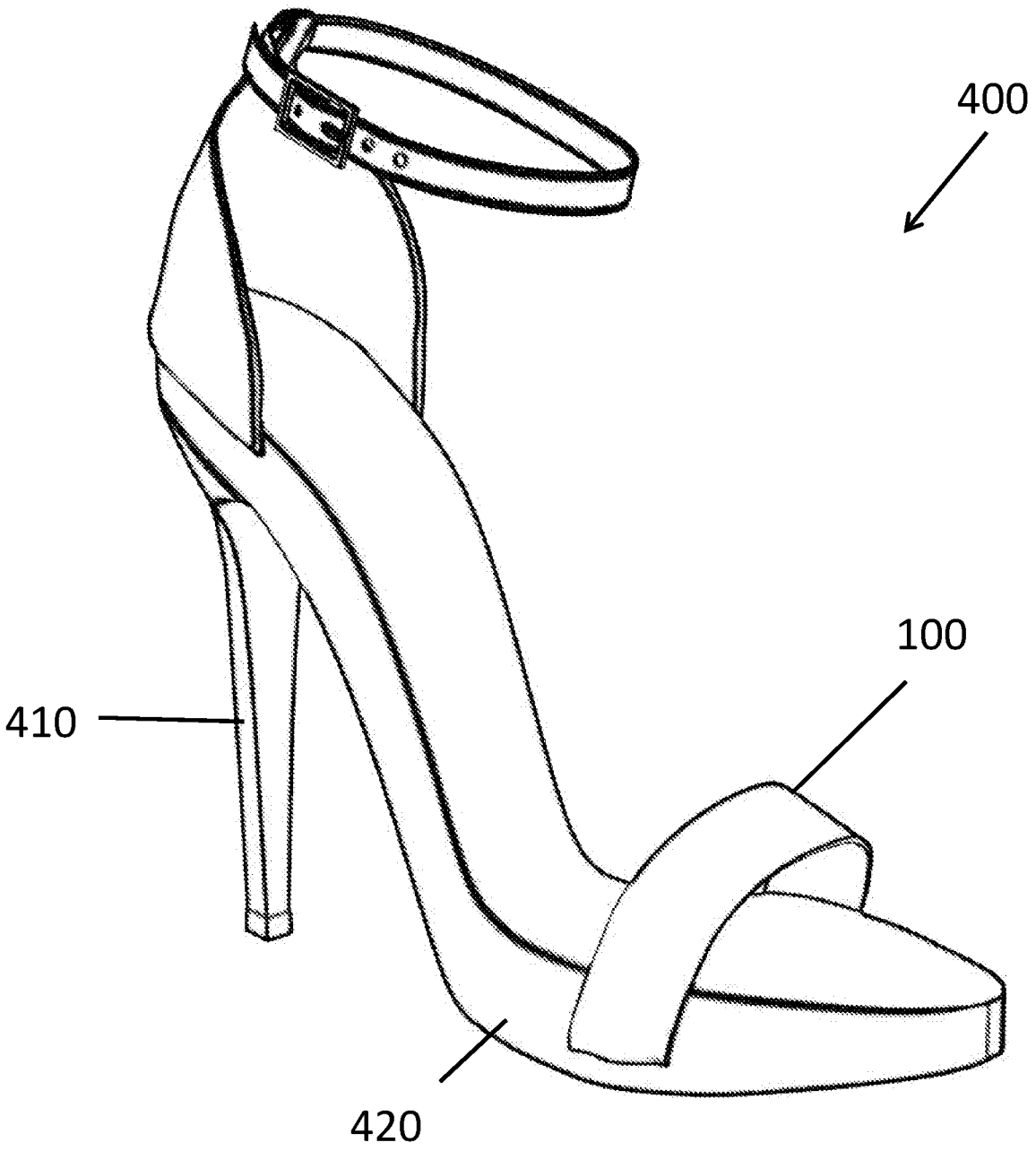
FIG. 4A schematically illustrates a perspective view of high heel footwear, according to another embodiment of the present invention.

FIG. 4A schematically illustrates modular footwear 400 in form of a high heel shoe, according to another embodiment of the present invention. Modular footwear 400 comprises an interchangeable display strap 100 and an interchangeable heel 410 that are both detachable from sole 420 of footwear 400, enabling to replace the display strap 100 with another and/or one form of heel with another, e.g., a user may choice between high shoe heel such as heel 410 to a shoe with a much lower heel, heel with a different shape or design, etc.

Figure 4B:
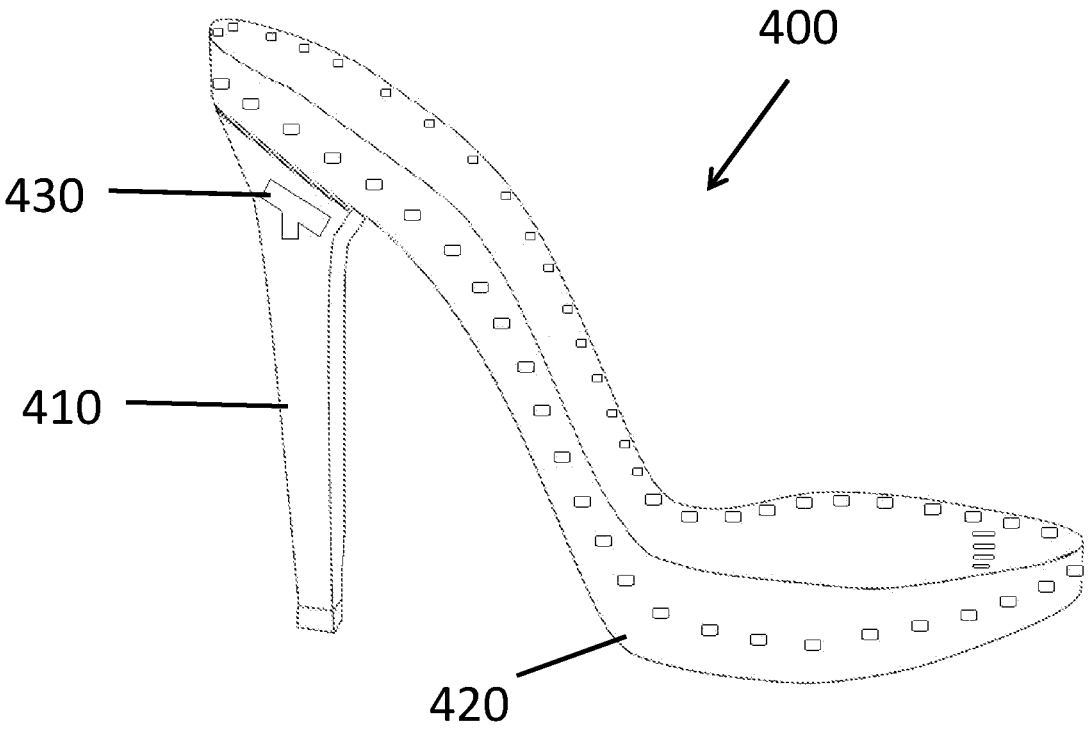
FIG. 4B schematically illustrates the sole portion of the high heel footwear of FIG. 4A, according to an embodiment of the invention.

FIG. 4B schematically illustrates footwear 400 without interchangeable display strap 100.

According to another embodiment of the present invention, heel 410 comprises attachment means 430, thus allowing the attachment (and power supply) of a display panel to the rear face of heel 410.

According to yet another embodiment of the present invention, footwear 400 comprises one or more sensors, such as light and/or sound sensing devices, that are adapted to manipulate the displayed media in accordance with readings obtained by such sensors, e.g., changing the displayed media or the intensity of the display according to light and sound levels obtained by each sensor.

According to an embodiment of the invention, footwear 10 and 400 are waterproofed, thus the display straps as well as the connecting means such as attachment means on the footwear's sole should be provided with suitable sealing means or degree of protection provided against water, such as IP code (i.e., International Protection Marking, IEC standard 60529, sometimes interpreted as Ingress Protection Marking) that classifies and rates the degree of protection provided against intrusion (body parts such as hands and fingers), dust, accidental contact, and water by mechanical casings and electrical enclosures.

According to an embodiment of the present invention, the footwear may comprise fashionable accessories that can be installed in different parts of the footwear, such as the heel, sole or parts of footwear's parts above the sole. According to an embodiment of the present invention, battery 220 may supply electric power to such fashionable accessories (i.e., which includes power consuming elements such as an air blower or an electric motor), such as: a rotatable flower with a miniature electric motor or a miniature fog machine.

Figure 5:
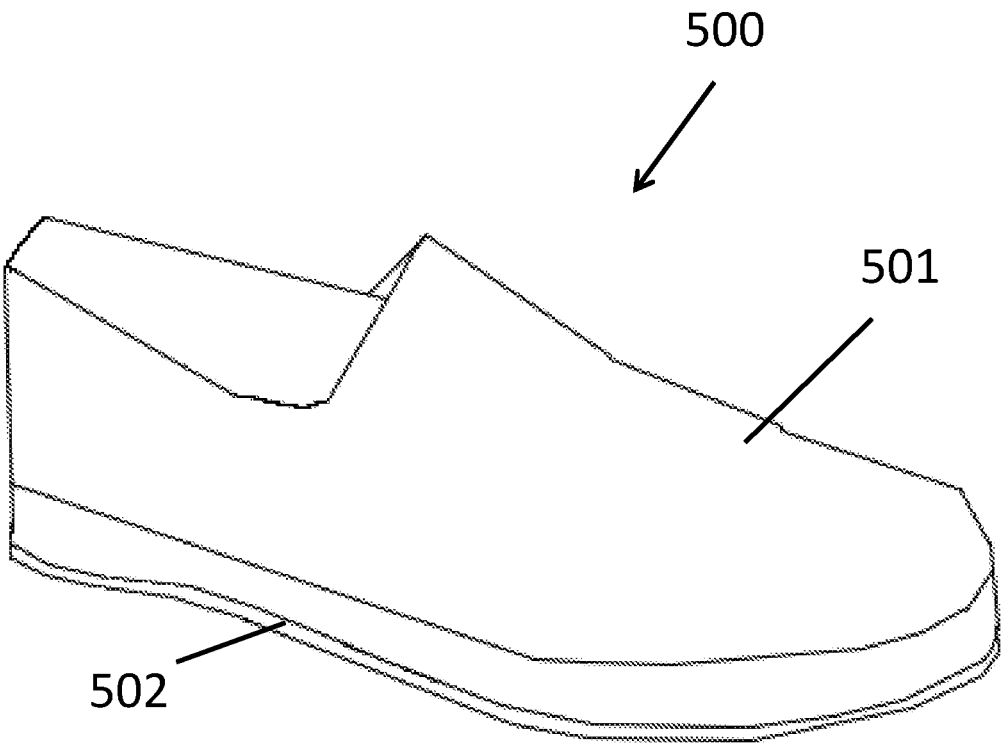
FIG. 5 schematically illustrates footwear provided with an upper part that fully enclosing the footwear top, according to an embodiment of the invention.

FIG. 5 schematically illustrates footwear 500 provided with an upper part 501 that fully enclosing the footwear top above sole 502, according to an embodiment of the invention. Upper part 501 can be made of a flexible display strap, or it may combine of regular straps or regular footwear's upper parts and of one or more flexible display straps that are utilized to compose a fashionable design of partial or full enclosure footwear.

According to some embodiments of the present invention, the footwear comprises one or more retractable straps. The one or more straps can be stored in corresponding sockets embedded within the footwear's sole and can be selectively retracted upon demand by a user. For example, in such embodiment, a retraction mechanism (e.g., a pop-up-based mechanism) may comprise rails through which the straps can be pulled out of the sockets or retuned into the sockets.

Although embodiments of the invention have been described by way of illustration, it will be understood that the invention may be carried out with many variations, modifications, and adaptations, without exceeding the scope of the claims.

The invention claimed is:

1. Footwear with flexible display means, comprising:

a) at least one strap that is comprised of a flexible thin display panel, wherein said at least one strap comprises attachment means that are designed to allow both mechanical connection and electrical connection;

b) a sole comprising attachment latches adapted to attach the at least one strap to said sole by said attachment means; and c) an electrical circuitry configured to enable the flexible thin display panel to display digital content by transferring data and charging said flexible thin display panel via said attachment means, thereby providing personalized footwear through controlling both its physical shape and its appearance.

2. The footwear according to claim 1, in which the electrical circuitry comprising a processing unit, a memory, a battery, data and electric power ports.

3. The footwear according to claim 1, in which the electrical circuitry is located within the sole, within the strap or in both within said sole and within said strap.

4. The footwear according to claim 1, in which the attachment latches are provided in form of data and electric power ports for electrically connecting between the at least one strap and the electrical circuitry and for mechanically connecting between the at least one strap and the sole.

5. The footwear according to claim 2, in which the battery is of a rechargeable type and the electrical circuitry further comprising electrical charging means for charging the battery by an external charger in a wireless or wired manner.

6. The footwear of claim 1, further comprising an external memory device reader adapted to transfer digital content to the flexible thin display panel either directly or via the electrical circuitry.

7. The footwear of claim 1, further comprises a wireless communication device to wirelessly communicate with a remote device, which is utilized as a media source and can control the displayed digital content.

8. The footwear of claim 5, in which the sole comprises an electricity generation mechanism for charging the battery.

9. The footwear of claim 8, in which the electricity generation mechanism is embedded within the sole or within a heel of the sole.

10. The footwear of claim 1, in which the sole comprises a modular heel.

11. The footwear of claim 1, in which the sole is configured to power external power consuming devices.

12. The footwear of claim 1, further comprising one or more sensors adapted to manipulate the displayed digital content in accordance with readings provided by said one or more sensors.

13. The footwear of claim 12, wherein the one or more sensors is a light sensing device, a sound sensing device or combination thereof.

14. The footwear of claim 1, in which the sole comprises a plurality of attachment latches that are distributed along said sole, thereby enabling to form a variety of designs by combining the attachment of one or more straps at different locations of said sole.

15. The footwear of claim 1, in which a combination of regular straps or footwear's upper parts and of display straps is utilized to compose a fashionable design of a partial or full enclosure.

16. The footwear of claim 2, in which the battery supplies electric power to fashionable accessories comprising power consuming elements.

17. The footwear of claim 1, in which the straps are retractable.

18. The footwear of claim 17, in which the straps are stored in corresponding sockets embedded within the footwear's sole and can be selectively retracted upon demand by a user.

* * * * *